US007744482B1

(12) United States Patent
Watson

(10) Patent No.: US 7,744,482 B1
(45) Date of Patent: Jun. 29, 2010

(54) PUTT SENSOR TRAINING DEVICE

(76) Inventor: Michael Watson, 11423 Rosemont Dr., Rockville, VA (US) 23146

( * ) Notice: Subject to any disclaimer, the term of this patent is extended or adjusted under 35 U.S.C. 154(b) by 0 days.

(21) Appl. No.: 12/555,014

(22) Filed: Sep. 8, 2009

(51) Int. Cl.
*A63B 69/36* (2006.01)

(52) U.S. Cl. ..... 473/221; 473/257

(58) Field of Classification Search ..... 473/198, 473/199, 219, 220, 221, 222, 225, 257
See application file for complete search history.

(56) References Cited

U.S. PATENT DOCUMENTS

| | | | | |
|---|---|---|---|---|
| 4,150,825 | A | | 4/1979 | Wilson |
| 4,342,455 | A | | 8/1982 | Miyamae |
| 4,342,456 | A | | 8/1982 | Miyamae |
| 4,437,672 | A | * | 3/1984 | Armantrout et al. ..... 473/153 |
| 4,872,687 | A | | 10/1989 | Dooley |
| 4,997,189 | A | | 3/1991 | Perkins |
| 4,999,835 | A | | 3/1991 | Lagoutte |
| 5,067,718 | A | | 11/1991 | Knox et al. |
| 5,082,276 | A | | 1/1992 | Stevens |
| 5,169,150 | A | | 12/1992 | Tindale |
| 5,169,151 | A | | 12/1992 | Conley |
| 5,213,331 | A | | 5/1993 | Avanzini |
| 5,324,039 | A | | 6/1994 | Reimers et al. |
| 5,435,561 | A | | 7/1995 | Conley |
| 5,465,972 | A | | 11/1995 | Cornett |
| 5,472,205 | A | * | 12/1995 | Bouton ..... 473/222 |
| 5,527,041 | A | | 6/1996 | Terry, III et al. |
| 5,611,739 | A | | 3/1997 | Carney |
| 5,692,966 | A | | 12/1997 | Wash |
| 5,788,588 | A | | 8/1998 | Hooker |
| 5,964,668 | A | | 10/1999 | Tai et al. |
| 6,146,283 | A | | 11/2000 | Ferguson, III |
| 6,213,887 | B1 | | 4/2001 | Carney |
| 6,227,984 | B1 | | 5/2001 | Blankenship |
| 6,338,682 | B1 | | 1/2002 | Torchia et al. |
| 6,461,248 | B1 | | 10/2002 | Gross |
| 6,607,448 | B2 | | 8/2003 | Moore |
| 6,736,735 | B2 | | 5/2004 | Galanis et al. |
| 6,821,211 | B2 | | 11/2004 | Otten et al. |
| 7,022,026 | B2 | | 4/2006 | Blankenship |
| 7,220,187 | B2 | | 5/2007 | Schmidt et al. |
| 7,255,649 | B1 | | 8/2007 | McConnell |
| 7,288,032 | B2 | | 10/2007 | Chabala |
| 2002/0173365 | A1 | | 11/2002 | Boscha |
| 2005/0119063 | A1 | | 6/2005 | Tupman et al. |
| 2006/0287119 | A1 | | 12/2006 | Penner et al. |

* cited by examiner

*Primary Examiner*—Nini Legesse
(74) *Attorney, Agent, or Firm*—Thomas, Karceski, Raring & Teague, PC

(57) ABSTRACT

The present invention provides a portable device that can be used anywhere and that enables a golfer to improve putting performance, for training or entertainment purposes. The device has an electronic analyzing system comprising, in one embodiment of the invention, only three passive infrared sensors to accurately detect all the crucial movements of a putter head (or any other golf club) (e.g., squareness at impact, speed, distance) throughout the crucial portion of a swing at the virtual point of impact (or actual point of impact if a golf ball is used). The device further uses these sensors to capture information in tandem with preset and/or selectable features and options (e.g., stimp, slope, statistics, games) to supply a holistic approach to putting practice. The device may also be equipped with an accelerometer/inclinometer to instantly inform the user of the slope and drop of the ground on which the device is placed.

19 Claims, 10 Drawing Sheets

PUTT SENSOR TRAINING DEVICE

FIELD OF THE INVENTION

The present invention relates generally to golf training and practice devices.

BACKGROUND

Throughout the age of golf, putting training has stayed in a primitive stage while tireless efforts have been made in developing tools and devices to improve all other aspects of the game. Many golfing simulators and training/practice systems enable golfers to practice drives and chip shots, but none of these address the specific and unique aspects of the real needs that golfers have to improve their putting abilities in a very reliable, simple and portable design.

BRIEF SUMMARY

Embodiments of the present invention provide a portable device that can be used anywhere and that enables a golfer to improve putting performance, for training or entertainment purposes. This device offers: visual, audible and physical feedback while and through real like course results and entertainment modes, developing and keeping the users interest. The device has an electronic analyzing system comprising, in one embodiment of the invention, only three passive infrared sensors to accurately detect all the crucial movements of a putter head used in the act of putting (e.g., squareness of putter head at impact, speed, distance) throughout the crucial portion of a putting swing at the virtual point of impact (or actual point of impact if a golf ball is used). The device further uses these sensors to capture information in tandem with preset and/or selectable features and options (e.g., stimp, slope, statistics, games) to supply a holistic approach to putting practice. Information is conveyed to the user instantly through a display (e.g., LED/LCD), audio, and/or other options within the compact portable device. The device may also be equipped with an accelerometer/inclinometer to instantly inform the user of the slope (in two dimensions—foreswing to backswing and front edge to back edge) and drop of the ground on which the device is placed. Knowing the slope helps teach a golfer to determine slope angle while practicing or just prior to putting the greens of the course. The device can be used while waiting for a group to putt on the greens of a course. This would enable the user to be more familiar with the speed and feel of the greens (without touching or rolling their ball on the green) prior to putting therefore speeding up course play.

Embodiments of the present invention help develop the most crucial aspect of the game (i.e., putting) using mostly any putter or club, with no attachments, tapes, mechanics, limitations, guides to inhibit, objects to hit, pass through, tunnels, balls through sensors, reflect off of, or bounce against another. The user is able to develop a feel, confidence and repeatable skill with their uninhibited putter or someone else's putter (if they lost or forgot theirs and had to borrow one or just bought a new one and didn't have ample time to practice) in a realistic facsimile of the putting experience—whether a young child, novice or pro and regardless of grip or swing style. The way the sensors are triggered also allows someone to putt without a backswing if so desired. An optional guide could be added with two through holes cut in the upper deck with through rods and a thin strip of metal connecting them to allow for an adjustable guide that would be parallel with the upper deck plan. This guide could be used or the face of the upper deck could be used for those golfers that prefer a straight back/forth putt stroke. The optional guide could just allow the user to adjust where the guide would position the swing via a couple of fastening wing nuts or other fasteners.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1. is a perspective view of a golfer using a system for analyzing the swing of a putter, in accordance with embodiments of the present invention;

FIG. 2. is a perspective view of the system of FIG. 1;

DETAILED DESCRIPTION

Figure 1:
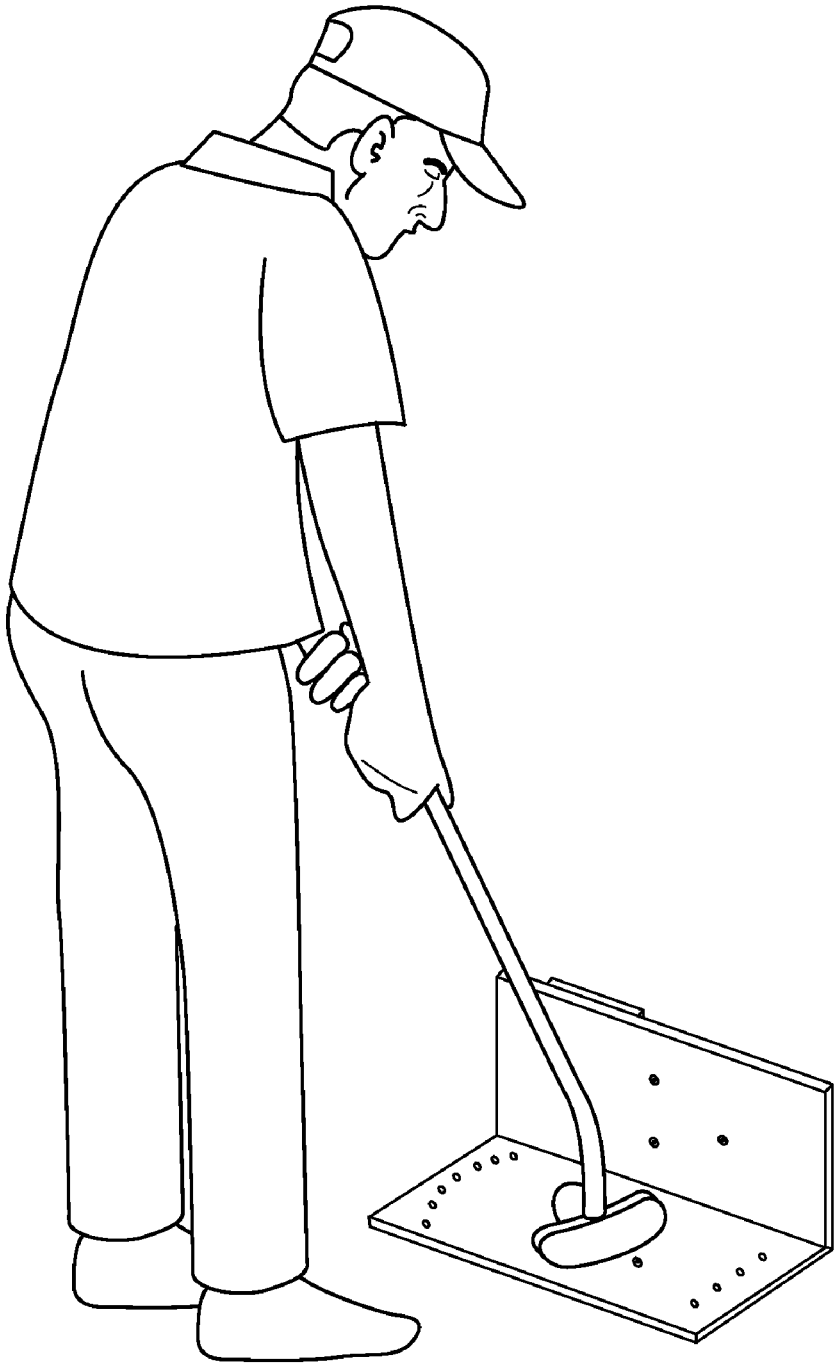

Embodiments of the invention comprise a novel putting training device designed to answer the age old questions encountered by a new golfer or a golfer looking to improve: what do I do with my body, head, arms, hands and grip given different techniques, body types, musculatures, strengths, heights, stances, arc of swings, swing paths, grips, etc. The device accommodates every individual, regardless of specific technique, thereby building consistency, touch and control while training the body and mind to have skills desirable in the field of play. It reduces a neck jerk reaction (called yips) due to mostly inexperience of nerves by allowing the user the immediate practice and confidence building. All of this packaged in a portable device that every golfer can afford. The device can improve speed of play by familiarizing the user with club head position and swing through impact at the desired speed for desired distance they are practicing, significantly reducing two, three and four or more putts when trying to get the ball in the hole, thereby reducing backups on courses which in turn allows more play and more income due to preventing golfers from having bad putter experiences and being discouraged and not wanting to come back. Also, it prevents experienced players from being discouraged by courses backed-up with novice golfers who are three, four and five putting and therefore more reluctant to return. The device improves confidence and should not only be the best tool ever for youth to take to the game with quick success (which builds interest) but also for the average-to-poor player to avoid embarrassment during their greens play, allowing them to play the game with more confidence. This device would also encourage more people to play in captain's choice type tournaments knowing if they practice with this device, they will be able to contribute more to the team in being a better putter. This device would aid the golf world and course in being the great equalizer and bridging the gap between the very off balanced numbers of today's 80/20 of bad to good putting players in the field.

The rules of golf state that greens cannot be tested while the player is on the green, meaning the player cannot hit their ball across the surface of the green because it would allow them to practice in the real environment on that green. This device enables players to simulate the greens and speed up play without touching a ball to a green or rolling it across the green. The device also allows them to practice while play is slow or while waiting to hit up, (which some players try to do now with no device but only swinging in the air, to try to get rhythm and reduce nerves to little success) and provides helpful feedback that increases the effectiveness of such practice. This device will significantly reduce yips (nervousness, jumpiness and miss hits) and speed up play to create more interest in returning to the course due to the confidence built, thereby aiding in boosting economy and bolstering the game play. All of this is accomplished without the need to add reflecting tape or sensors to a putter, both of which can add weight and alter the feel and touch of the club and are illegal to play with on the face of a club changing the club surface during practice. There is no need to modify swing type to use the device, but the device allows a user to try different swing types (examples: a straight line method or an arc style method) quickly to determine which type best suits the user's body frame or musculoskeletal system.

This device is the first portable device particularly that will be available to all users on site at crucial times in their game enabling the vast immediate simulated desired results that they can select immediately and practice effectively (speed, stimp, slope, distance, touch (hands/arms and body sensing through practice the proper feel through acceleration, grip and speed all the way through the back swing and the finish of the putt stroke), square at impact, slide (optionally)). Using only three sensors to accomplish all of these features reduces: cost, crosstalk of sensors, in-field failures (insuring product reliability), confusion to the user, and busyness of the platform which can distract from the very nature of what the user is trying to accomplish. Also, the first portable device to utilize the real like practice and game features users would utilize after a round to still compete and fraternize when they cannot play another round, but are not ready to stop playing, yet a great camaraderie builder.

Referring now to FIG. 1, a perspective view of a golfer using a system for analyzing the swing of a putter is illustrated, in accordance with embodiments of the present invention. The system illustrated in FIG. 1 is intended for right-handed golfers (a system that is a mirror image of the system of FIG. 1 would be used by left-handed golfers and is within the scope of this application). While embodiments of the invention are described herein in relation to use of a putter and the act of putting, embodiments of the invention can be used with any type of golf club.

Figure 2:
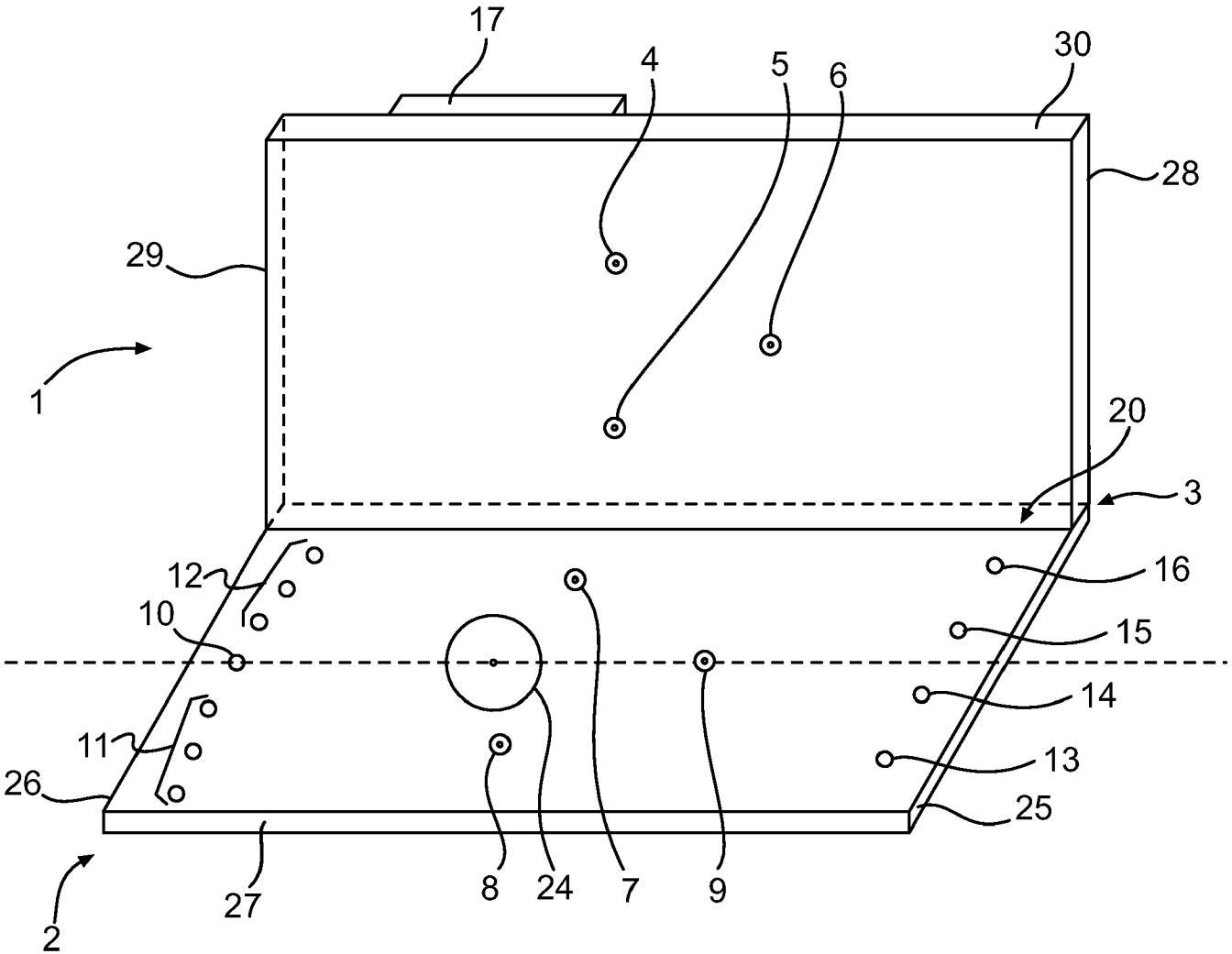
Figure 3:
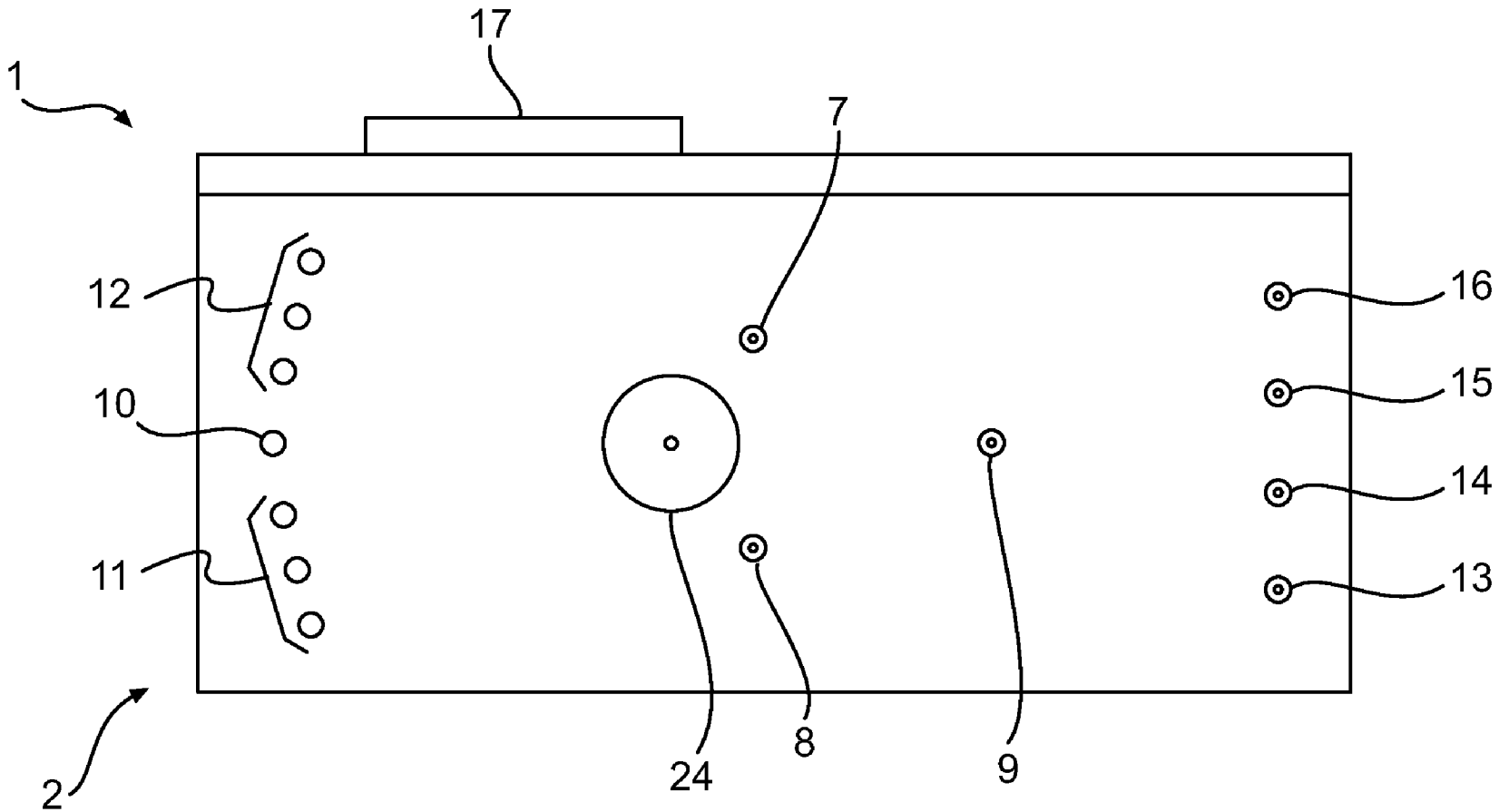
FIG. 3 is a top view of the system of FIG. 1.
Figure 4:
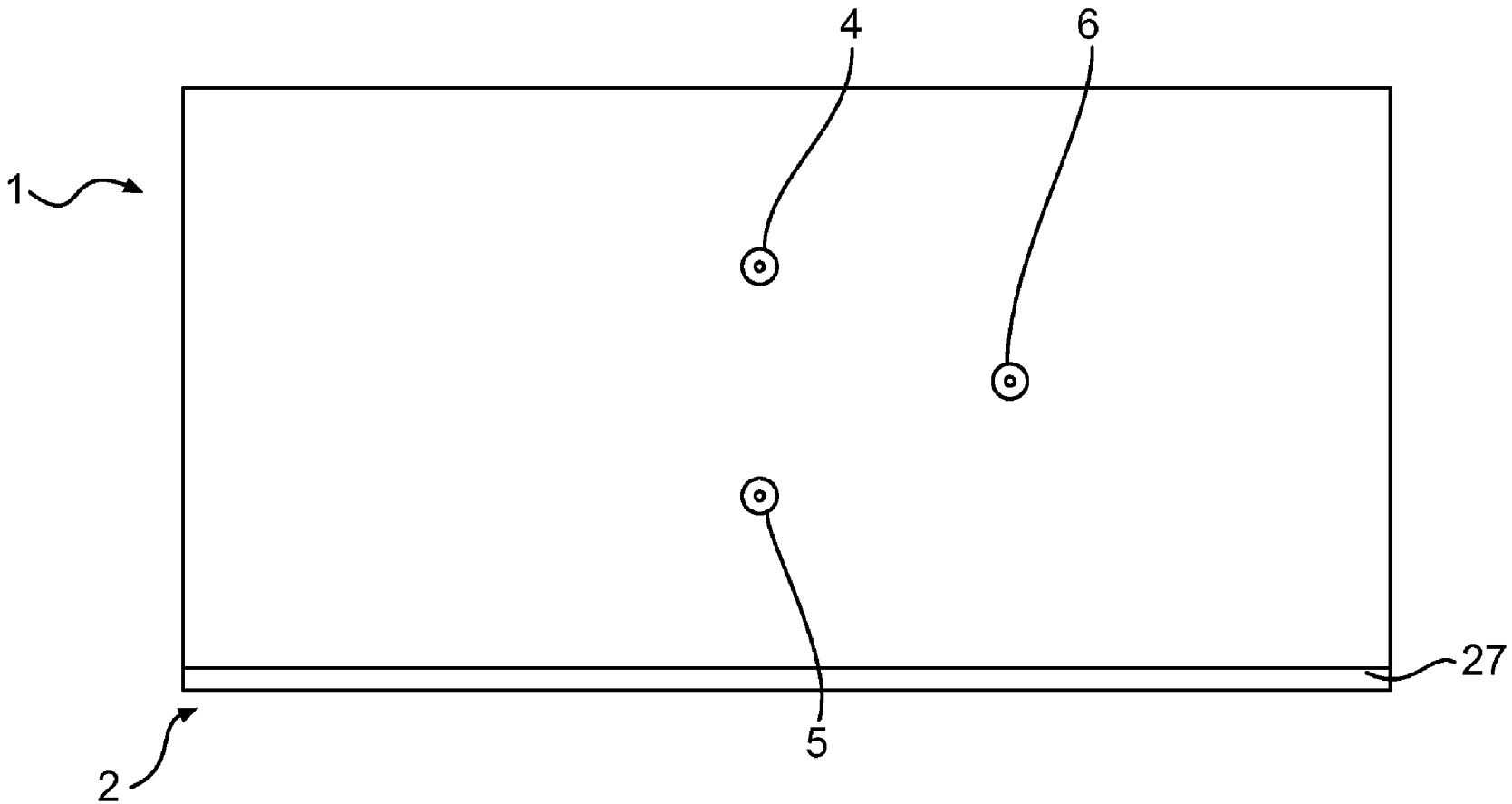
FIG. 4 is a face view of the system of FIG. 1.

Referring now to FIGS. 2-4, perspective, top, and face views of a system for analyzing the swing of a putter are illustrated, in accordance with embodiments of the present invention. The system comprises an upper deck 1, a lower deck 2, a hinge 3 or other means of affixing the upper and lower decks (forming a substantially straight line 20 where the upper and lower decks meet, which provides a practice guide for users who have a straight back-and-forth putting technique), three upper deck sensor elements 4, 5, 6, three lower deck sensor elements 7, 8, 9, a center indicator light 10, side indicator lights 11, 12 on either side of center light 10, a golf ball target area 24, a controller (not illustrated), one or more selector switches (e.g., stimp selector switch 13, slope selector switch 14, game selector switch 15, mode selector switch 16), display element 17, removable or fixed harness or straps or other means for attaching the portable device to something (not illustrated), power source (not illustrated) such as a battery selected for light weight, long life, quickness of recharge and multiple recharges, an accelerometer/inclinometer (not illustrated) for determining the slope of the surface on which the system is placed (in two dimensions—foreswing to backswing and front edge to back edge). The display element 17 is typically mounted such that the display portion (i.e., the "screen") is even with the top edge 30 of the upper deck 1 to enable the displayed information to be readily visible to a user, but can be mounted any where on the device or remotely mounted (which would enable it to, for example, be incorporated into a golf bag or carried on a golfer's belt). Remote mounting would require wireless communication (e.g., Bluetooth or any other suitable type of beaming or signal) from the device to the display.

As shown in FIG. 1, the golfer stands adjacent the front edge 27 and faces the system. The golfer may place a ball on the target area 24 and actually hit the ball with the putter, or the golfer may simulate hitting a ball but not actually place a ball on the target. The system works equally well regardless of whether an actual golf ball is used or hitting the ball is simulated. The golfer hits or simulates hitting a ball to the left (relative to FIGS. 1 and 2). The golfer begins by holding the putter such that the putter head is directly behind (to the right of, in FIGS. 1 and 2) the target area. The golfer takes a backswing (to the right) in preparation and then a foreswing (to the left) to actually hit (or simulate hitting) the ball. Because of these swing directions, the end 25 of the bottom deck and the end 28 of the upper deck may be termed "backswing ends" and the end 26 of the bottom deck and the end 29 of the upper deck may be termed "foreswing ends." While the described embodiment of the invention is configured for a right-handed golfer, it should be appreciated that alternative embodiments of the invention may be configured for left-handed golfers. For embodiments configure for a left-handed golfer, the herein described embodiment would be reversed such that the swing would be to the right.

Embodiments of the invention use three sensors to detect movement of the putter head. The timing and order in which each sensor detects movement is used by the controller to determine speed and angle of the putter head, which is in turn used to determine distance and direction a golf ball would travel if hit by a putter having the determined speed and angle (as discussed in more detail below). The three sensors are typically passive infrared (PIR) sensors, each sensor comprising an emitter and a detector. The sensor sends a signal to the controller when the putter head interrupts the passage of light between the emitter and the detector. The upper deck 1 houses three upper deck sensor elements 4, 5, 6 and the lower deck 2 houses three lower deck sensor elements 7, 8, 9. In one embodiment, the upper deck sensor elements 4, 5, 6 are all emitters and the lower deck sensor elements 7, 8, 9 are all detectors. In another embodiment, the upper deck sensor elements 4, 5, 6 are all detectors and the lower deck sensor elements 7, 8, 9 are all emitters. In yet another embodiment, the upper deck sensor elements are a mix of emitters and detectors and the lower deck sensor elements are a corresponding mix of emitters and detectors. In any event, where an upper deck sensor element is an emitter, the corresponding lower deck sensor element must be an emitter and vice versa.

The three upper deck sensor elements are arranged in an isosceles triangle configuration, and the three lower deck sensor elements are also arranged in an isosceles triangle configuration. Two of the lower deck sensor elements 7, 8 (these may be termed the "forward sensors") are mounted equidistant from the target area and equidistant from an imaginary line that bisects the target area and is substantially parallel to the front edge 27. The third lower deck sensor element is mounted on the imaginary line, closer to the backswing end 25 than are the other two lower deck sensor elements. The upper deck sensor elements are mounted in a mirror-image arrangement to the corresponding lower deck sensor elements. The distance between lower deck sensor element 7 and lower deck sensor element 8 (and therefore the distance between the corresponding upper deck sensor elements) is designed to accommodate most or all commercially available putter heads. Similarly, the distance between lower deck sensor elements 7, 8 and lower deck sensor element 9 (and therefore the distance between the corresponding upper deck sensor elements) is designed to accommodate most or all commercially available putter heads such that the putter head is able to "fit" between elements 7, 8 and element 9 without triggering any of these sensor elements. The shorter the distance between lower deck sensor elements 7, 8 and lower deck sensor element 9 (and therefore the distance between the corresponding upper deck sensor elements), the faster the controller and clock must be to more accurately determine club head speed or change timer resolution. The sensors could have transparent coverings or reflective coated material to protect the sensors as an option.

This arrangement of the sensors allows the user to position the putter head just behind the front two sensors, such that in the backswing the timers are reset and the display is reset. Once the forward swing commences and passes the reset sensor, timers are again reset and about 6-9) the timers are again reset and begin the actual timing for indication of distance and club head. This virtual ball distance and putter head angle at the point of virtual impact. (This works with predominately any putter club head).

Unlike some other devices which utilize retroreflective technology (a method of light detection in which infrared light is emitted and sensed by the same physical sensor; the infrared light is either reflected from the object being sensed or is reflected with a mirror of sorts), throughbeam detection as used by embodiments of the invention allows for more exact detection with negligible PIR device precision error. Some commercially available PIR sensors must detect a 40 kHz carrier for better ambient light discrimination which introduces time delay to the methodology while relatively slow LED modulation is filtered. Using passive devices, as in embodiments of the invention, eliminates any delay imposed from filtering.

Ambient light detection is avoided by placing the emitters in the base shooting upward at the detectors which are faced downward. Recessing the detectors into the upper deck also helps reduce the detection of ambient light. The quantity, spacing and type of sensors and the material being used as well as the optional counter sinking of sensors was designed for minimal cross talk, ambient light detection, and club reflection interference. In addition, infrared light is invisible to the human eye so placing the light emitters in the base of the device does not present a distraction. An important aspect to the construction is the vertical plane positioning of PIR pairs (4-8) and (5-7). It is important that these devices are positioned to be true in the Y axis in order to detect the flat surface of a given putter face. Any variation will introduce error from the underneath or top surface of the given putter. The putter faces are typically flat or predominantly flat across their surfaces. Whether the sensor catches the top edge or bottom edge does not matter. The device will still accurately detect the putter head positioning.

Figure 5:
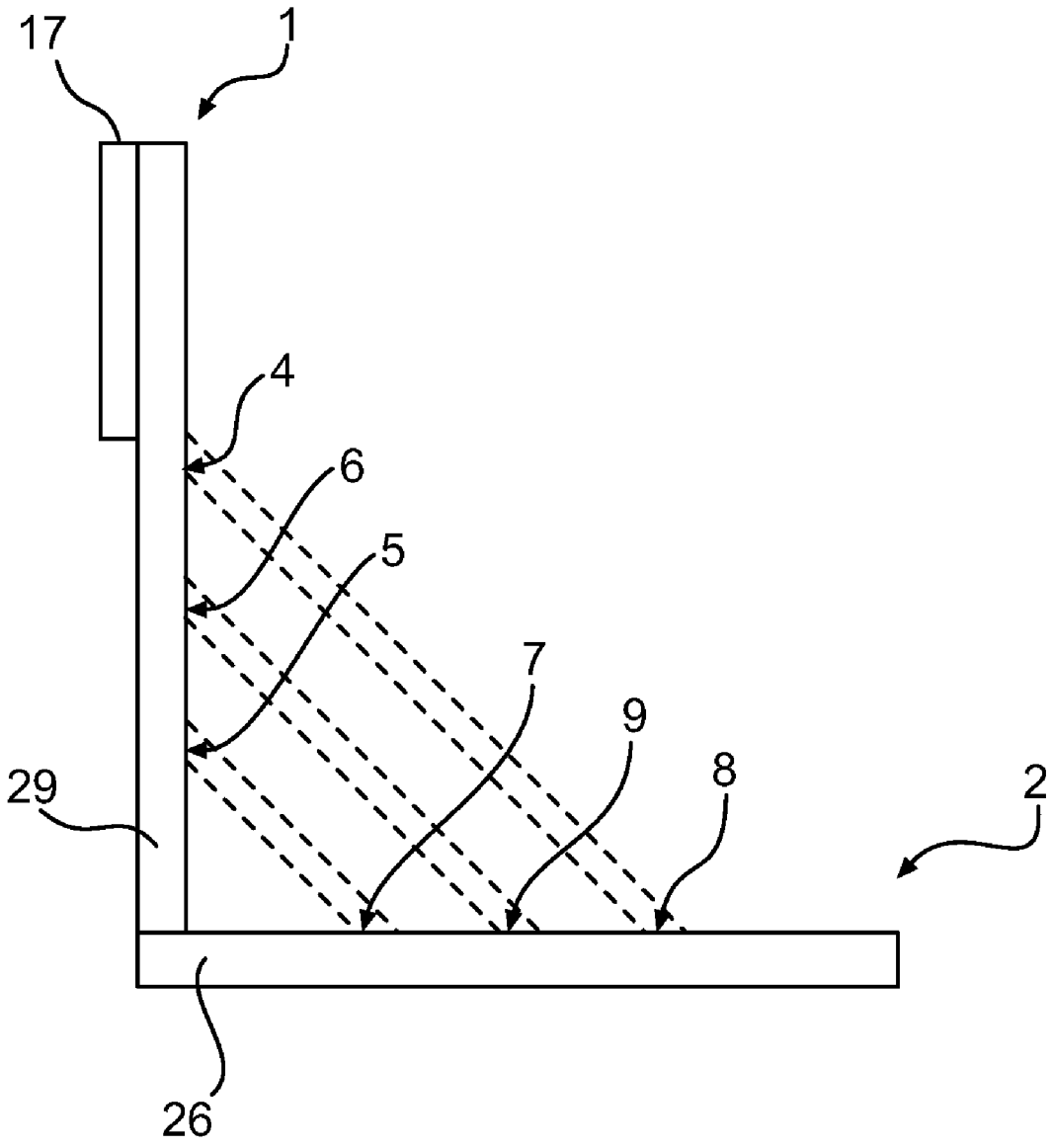
FIG. 5 is a side view of the system of FIG. 1.

PIR emitters and detectors are used to directly detect the club head as the club head passes through each of the three associated beams (i.e., the beam between 4 and 8, the beam between 5 and 7, and the beam between 6 and 9, as illustrated in FIG. 5). The rightmost (from the point of view of the golfer in FIG. 1) sensor pair (6-9) starts the controller processing operations. When the light beam for PIR sensor pair (6-9) is blocked by a club head, a positive-to-negative transition is detected by the controller and the controller is interrupted from whatever other program routine is being run and performs the following actions: (1) reset the distance display (i.e., the display is reset to "00"); (2) turn off all of the display LED's (10, 11, 12) that may be displaying the results of the last simulated putt; and (3) reset the associated internal controller timer to zero. These actions occur whether the said club head is in forward swing or back swing motion. There are no erroneous, interim, or other conspicuous functions occurring from these actions if the club head is in back swing, so as to not distract the user. All actions will repeat internal to the controller when the club head is subsequently set in a motion for a forward swing. Repeating these actions in forward swing will reveal nothing to the user because output states were achieved as described earlier in backswing. There will be no additional output for the display and the LED's until after the sensor pairs (4-8) and (5-7) detect the presence of the club head which occurs in forward swing. In addition, the controller does not pause or repetitively perform operations as described while the club head completes its travel through the light beam of sensor pair (6-9). As mentioned the input to the controller from sensor pair (6-9) is configured as a negative-edge-triggered interrupt. That is, the reset operations described earlier only occur once per beam blockage. Furthermore, the aforementioned controller actions described do not occur when the club head completes its pass through the beam and a positive-edge is present on this same digital input to the controller. The device user may choose to block sensor pair (6-9) to reset functions so that reset actions do not pose distraction in the back swing.

To accommodate larger club heads, the operations that occur as described earlier when the club head blocks activates sensor pair (6-9) in the backswing or forward swing, the controller begins to calculate speed regardless of club head size (in the direction of swing travel). That is, the device will operate in such a way that sensor pairs (4-8) and (5-7) can be blocked while sensor pair (6-9) is still covered and timing and subsequent controller calculations will not be compromised. This is made possible with the configuration of the (6-9) sensor input for positive-to-negative edge detection. Sensors 4-8, 5-7 and 6-9 may have variable spacing (from smaller to larger distances) to cover any possible new fancy putter heads for optimal performance design. The positions of the sensors on the upper or lower decks can be configured to fully accommodate the predominance of club heads and shafts on the market.

In addition, club head designs which incorporate a conventional flat face surface and hollow portion(s) which provide multiple positive-to-negative transitions detected with one forward swing to sensor pair (6-9) are ignored for a time period determined reasonable while allowing for the fastest swing that will be experienced on an actual putting green.

Figure 7:
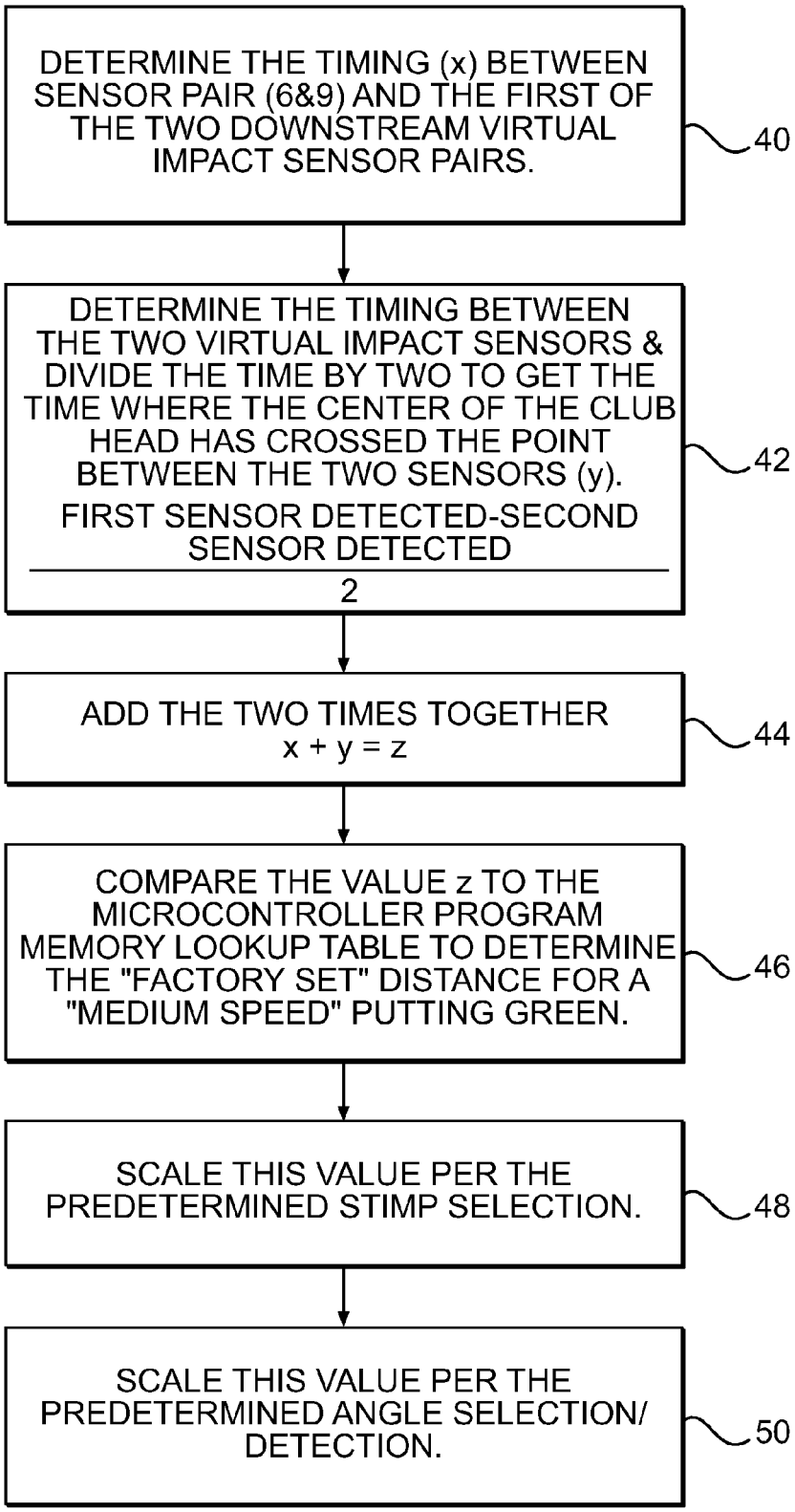
FIG. 7 is a flowchart of a method of determining an anticipated distance a golf ball would travel, in accordance with embodiments of the invention.

FIG. 7 is a flowchart of a method of determining an anticipated distance a golf ball would travel, in accordance with embodiments of the invention. The controller internal timer functions independently of the controller program counter and is thus subject to a very negligible amount of timing error (typically less than 5 microseconds) while the controller is dedicated to looking for beam blockages on pairs (4-8) or (5-7). After one of these sensor pairs detects the putter head, the internal timer value is temporarily moved into an internal controller register. This timer value is the timing (x) between the activation of sensor pair (6-9) and the activation of the first of the two downstream sensor pairs (4-8) or (5-7) (block 40). Note that the internal timer continues its timing until pair (6-9) detects the next blockage, providing a positive to negative digital edge transition.

The first sensor pair that experiences a club head detection ((4-8) or (5-7)) starts an internal timer which accumulates until the remaining sensor pair (opposite of that which may have been detected earlier) detects the club head. Once both sets of sensors have successfully detected the club head, the timer value is temporarily stored in an internal controller memory register and calculations begin to determine virtual ball distance and club head face angle. Timing of the theoretical center of the club head is determined and used for distance computations in order to prevent club head tilt from influencing the distance calculation. It is calculated with the following formula: y=((timing of first sensor detection of pairs (4-8) and (5-7)) minus (timing of second sensor detection of pairs (4-8) and (5-7))) divided by 2 (block 42).

After this value (y) is determined in block 42, the value is added to the time (x) accumulated and stored as described in block 40 to result in a value (z) (block 44). This final value (z) is compared to values in a memory lookup table accessible to the controller to obtain the distance value from the table that corresponds to the value (z) (block 46). In one embodiment of the invention, the table values are determined from laboratory testing, in which numerous test putts are made using an actual golf ball, the actual distance the golf ball traveled is measured for each test putt, the timing of the putter head detection for each test putt is recorded, the data is analyzed to determine "standard" values for timing versus distance. Table 1 illustrates a subset of such a table, comprising experimentally determined times (in milliseconds) and corresponding distances.

TABLE 1

| Time (z) | Distance |
|---|---|
| 10 msec | 2 feet/ 0.6 meters |
| 20 msec | 3 feet/ 0.9 meters |
| 40 msec | 4 feet/ 1.2 meters |
| 50 msec | 5 feet/ 1.5 meters |
| 75 msec | 6 feet/ 1.8 meters |

In other embodiments of the invention, the controller may determine ball distance via a predefined logical/mathematical calculation.

The distance value may then be further scaled up or down based on the user stimp selection (if a stimp selection is made by the user) (block 48), based on tilt angle(s) from the accelerometer/inclinometer (if the accelerometer/inclinometer detects a slope angle) (block 50), or based on both. For example, the distance determined in block 46 may be multiplied by one or more scalar values (e.g., one scalar value for stimp and one scalar value for slope) that may be determined experimentally and used to scale up or down the distance. The stimp scalar value for "fast" greens (e.g., a stimp value of thirteen) will be greater than one (thereby increasing the initial calculated distance), while the stimp scalar value for "slow" greens (e.g., a stimp value of three) will be less than one (thereby decreasing the initial calculated distance), and the stimp scalar value for "average" greens (e.g., a stimp value of eight) will be one (thereby not affecting the initial calculated distance). Similarly, the slope scalar value for a down angle will be greater than one (thereby increasing the initial calculated distance), while the slope scalar value for an up angle will be less than one (thereby decreasing the initial calculated distance), and the slope scalar value for a flat surface (no angle) will be one (thereby not affecting the initial calculated distance). If both stimp and slope are to be compensated for, the initial calculated distance is scaled by one of the scalar values and then the scaled value is scaled again using the other of the scalar values.

The final distance value is sent to the device display 17 in the form of distance in units of, e.g., feet or meters. This display can be configured such that final calculated value is displayed after the display scrolls up from zero in a way that simulates ball speed decay from ground friction. This scroll speed may be proportional to the speed of the swing.

Embodiments of the invention are capable of detecting the face angle of the club head, and indicating the direction in which a putted ball would travel based on the detected face angle. Following the putting action and distance calculations/determinations made up to this point, LEDs 10, 11, 12 at the left end of the device (as it is faced for putting) will indicate any putting face angle error. An acceptable straight shot (determined based on a club face that is perpendicular to the center line) is indicated with the center LED 10. Off-center shots are indicated by LEDs 11, 12 that are positioned on either side of center LED 10, thereby having the ability to indicate a shot that went either left or right of center and by how much. Each individual LED (of which there are six total in the embodiment illustrated in the figures) corresponds to three degrees of error, and the appropriate individual LED that corresponds to the off-center error will be illuminated, so the illustrated embodiment is able to indicate off-center errors of up to nine degrees right or nine degrees left. If the error is greater than a preselected out of range tolerance, it may be desirable to flash on/off all three LEDs (i.e., either all of 11 or all of 12) that correspond to which side of center the shot is determined to go based on the face angle. All display and LED indications will be latched until sensor pair (6-9) is blocked (i.e., triggered) as described earlier. Once pair (6-9) is blocked, the distance display is cleared to zero and all face angle LEDs are turned off. Sensitivity can be user-selected for the face angle LEDs, such as via switches 13, 14, 15, or 16 on FIG. 1.

The club face angle is measured by calculating the time difference between blockage of pair (4-8) and the blockage of pair and (5-7). The desired timer resolution is one microsecond per sample with an internal 16-bit controller timer. The face angle may be compensated by swing speed with the following formula:

$$\text{front delay} + \left(\frac{\text{front delay}}{10}\right)\left(\frac{\overline{speed}}{25}\right),$$

in which "front delay" is the time difference between blockage of pair (4-8) and the blockage of pair and (5-7), and speed is the complemented value of the club head speed. This compensation is desirable to prevent swing speed from influencing face angle determination.

All face angle LEDs may flash (e.g., three times) if a putt is made slower than can be accurately measured with the controller timer, which would indicate that the ball travel would have been less than one foot. This determination is made by the controller which is programmed to check a timer overflow flag.

If either pairs (4-8) or (5-7) are not covered in a timely fashion, the corresponding side of face angle LEDs may be illuminated. For example, if pair (4-8) is not covered when a swing is followed through, then LED 11 will flash three times. Similarly, if pair (5-7) is not covered in a timely fashion, then LED 12 will flash three times. The display will typically not indicate anything in this event. All timing operations are reset once pair (6-9) is covered once again, which will be the case on the next club swing.

The sensor elements may be flush-mounted or recessed to avoid ambient light and to protect sensors from elements. The sensor elements may be protected by a transparent covering, such as transparent coated lenses or angled lenses. Each sensor element is typically angled toward its corresponding element. The angle at which each sensor element is mounted is carefully selected to ensure that the emitter-detector pairs work together properly.

In one embodiment, sensor element 4 (which may be termed the "front top upper deck sensor element") is a PIR detector that receives infrared light from emitter 8 (which may be termed the "front outside lower deck sensor element"). Sensor element 5 (which may be termed the "front bottom upper deck sensor element") is a PIR Detector) that receives infrared light from emitter 7 (which may be termed the "front inside lower deck sensor element"). Sensor element 6 (which may be termed the "rear upper deck sensor element") is a PIR Detector that receives infrared light from emitter 9 (which may be termed the "rear lower deck sensor element"). FIG. 5 is a side view of the system, in which the dashed lines illustrate the infrared light traveling from emitter 8 to detector 4, from emitter 7 to detector 5, and from emitter 9 to detector 6.

Sensor elements 6, 9 acts as the trigger set of PIR sensors and sets and resets the counters based on the interrupt of an object passing over the beam.

The sensors are mounted at angles and positions that meet the needs of the putter heads yet have the accuracy to give the precision needed for the user's feedback. The sensors are mounted so they have the protection from the putter or other tooling as well as from ambient light or other lighting. Sensors 4-8 and or 5-7 can be arranged forward or backward, raised up or down or be arranged diagonally of each other to accommodate the predominance of most all putters if necessary.

Some of the system components (e.g., controller and battery) may be housed within the upper deck, which may be solid or hollow or any number of substraights. Some of the components (e.g., accelerometer/inclinometer) may be housed within the lower deck, which may also be solid or hollow.

Embodiments of the invention may comprise a visual display (e.g., LED or LCD display) to display, for example, distance, angle, score, mode, putter head not centered, virtual direction the ball went in a visual mode or degrees straight or right/left, speed, optimal slide or ball spin, etc. The invention may also comprise audio feedback, such as a synthesizer and speaker.

The system may be constructed using any suitable material to ensure that the device is heavy enough to set firm and not easily blow over yet be light enough for carry in a golf bag or suitcase and durable for the home or field and for children to use. The system may be embodied in a variety of shapes or sizes, and the upper and lower deck can be either hinged, solid, or multi compactable. In operation, the upper deck should be secured to the lower deck such that the upper deck is at or about a 90 degree angle to the lower deck. The device can be as small and trimline as a narrow strip hanging down from being attached to a golfer's bag, barely visible to those standing by. Also optional Bluetooth (or other wireless/RF) capability may be included for beaming data and results and otherwise communicating with the device, reloading or listening to prerecorded swing thoughts, coaching games, etc. The user could practice with the device on the lower portion of their bag and have the results beamed to an LED on the upper portion of there bag. This device could also be built into the golf bag or other carrier or vehicle. The device may be able to connect to the Internet (via any suitable communication technology) for web competitions and, for instance, simulated course play (e.g., a user could "play" Pebble Beach). Players would play on their devices via over the internet and compete with one another all over the world. A website could host tournaments and track/display rankings, etc. Such a website could also optionally track/display players' handicap information.

An array of lights (e.g., LEDs) 10, 11, 12 are arranged across the front end of the lower deck and indicate the determined direction in which a ball would travel based on the detected swing of the putter. Three LEDs are illustrated, but any number of LEDs may be used. A center LED 10 (which may be, e.g., red or green) provides the user a visual confirmation that the club head was square at the impact (both heel and toe of putter head crossing the two front emitters (7, 8) at the same time (within a margin of error). This helps the user in determining (minus the optional slide) that his/her putt rolled true down the middle to their target. This light can be set to flash a predetermined number of times or to remain steadily on for a predetermined time. The center light may be combined with audible feedback to indicate a straight putt. The outside lights 11 (which may be, e.g., red or green, but would typically be a different color than the center light) indicate that the determined direction of travel of a ball was to the left of center, with specific ones of the outside lights being lit to indicate exactly how far to the left of center (for example, each light may indicate one degree off center). The outside lights 12 (which may be, e.g., red or green, but would typically be a different color than the center light) indicate that the determined direction of travel of a ball was to the right of center, with specific ones of the outside lights being lit to indicate exactly how far to the right of center (for example, each light may indicate one degree off center). As with the center lights, the outside lights may be combined with audible feedback and may flash or burn steady. Audible and lights can be turned off for course play allowing use in only LED or Bluetooth feedback.

Embodiments of the invention comprise user input devices, such as pushbuttons or selector switches (FIG. 2 illustrates four such switches 13, 14, 15, 16, but the system may comprise a fewer or greater number of user inputs.) Stimp selector 13 that allows options for the user to select predetermined stimp settings allowing the user to determine how swing needs to be for the desired distance they need to hit the ball. Stimp is a measurement of how "fast" the greens are. The system can mimic any golf course in America and elsewhere since stimp is the measure used by most golf greenskeepers. The device could also be equipped with a USB connector for any downloads or for uploading or downloading user results or future course conditions if they become available through the web. Slope selector 14 allows options for the user to select pre-determined slope settings, allowing the user to practice putting in preparation for putting on a known slope. The slope selector may allow slope to be selected in predetermined increments (e.g., two degree increments), and to select an up or down slope. Game selector 15 allows the user to select from a plurality of predetermined games, allowing single or multiple players to compete in any number of games. For example, one game may require users to putt a specified distance several times, giving competitors statistics after each volley or at end of game. The games may have degrees of difficulty that can be set to accommodate children, amateurs, and professionals. Mode selector 16 allows a user to select from different modes to help them with where they are weak. Say ten or twenty degree uphill, twenty foot putts. As the user putts ten times, the system gives the user statistics of reached goal. The system may have a "dormant" or "stealth" mode in which all feedback to the user is turned off but the system continues to compile statistics to be displayed after the user finishes a series of putts or putting situations. The user may select an input to see the results. The system may include a statistics switch that allows a user to practice many different types of putts and give statistics to show where the user needs improvement. The switches are illustrated in the figures as mounted near the back end of the lower deck, but may be mounted anywhere desired on the system, or may be embodied in a multi-purpose selector switch.

Figure 6:
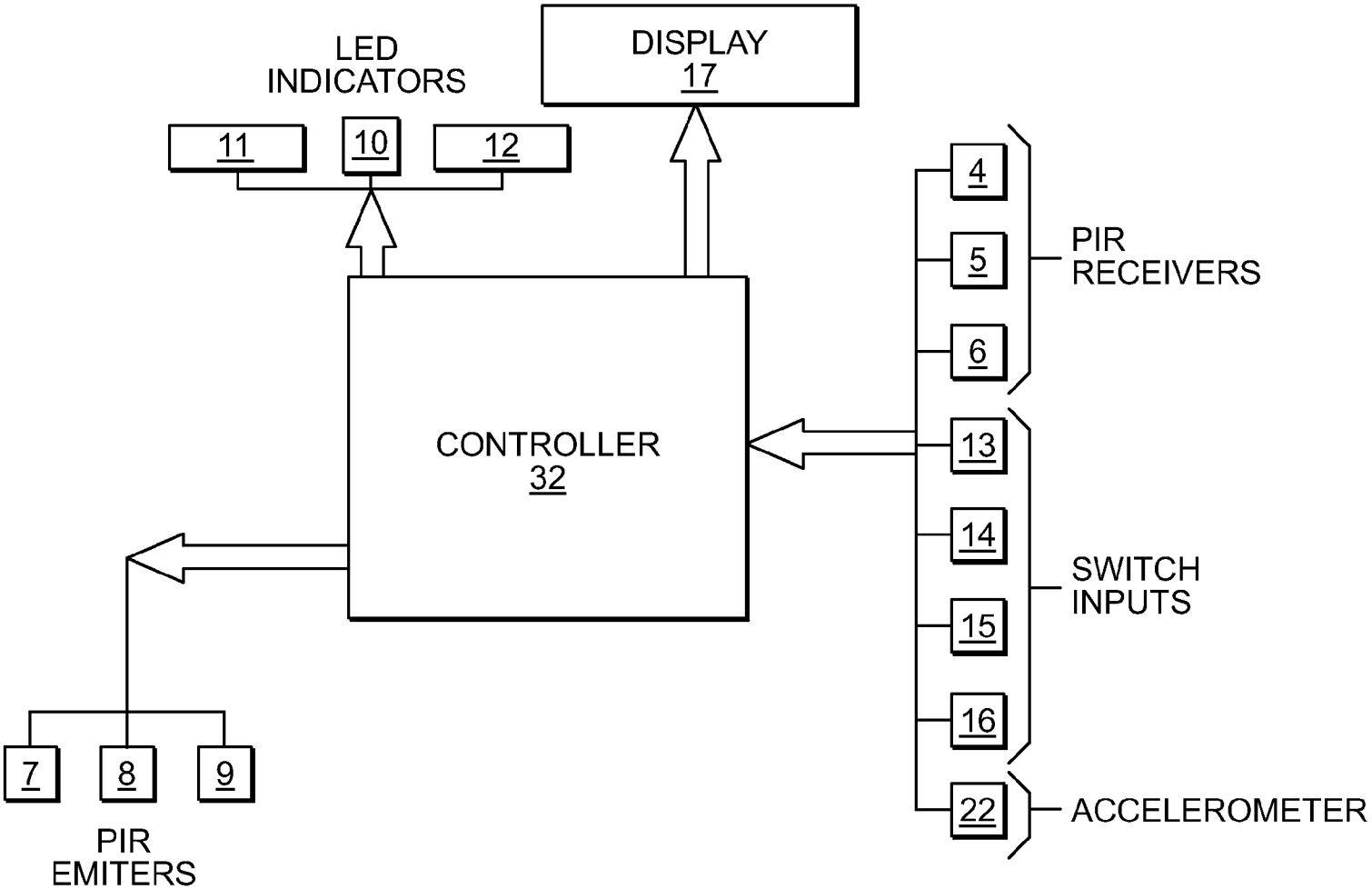
FIG. 6 is a block diagram of the electrical/electronic components of the system of FIG. 1.

FIG. 6 is a block diagram of the electrical/electronic components of the system of FIG. 1. In FIG. 6, it can be seen that the controller 32 receives inputs from PIR receivers 4, 5, 6, input switches 13, 14, 15, 16, and accelerometer 22 (or alternatively an inclinometer), and controls PIR emitters 7, 8, 9, LED indicators 10, 11, 12, and display 17. The controller may comprise a microprocessor, dedicated or general purpose circuitry (such as an application-specific integrated circuit or a field-programmable gate array), a suitably programmed computing device, or any other suitable means for controlling the operation of the device.

Figure 8:
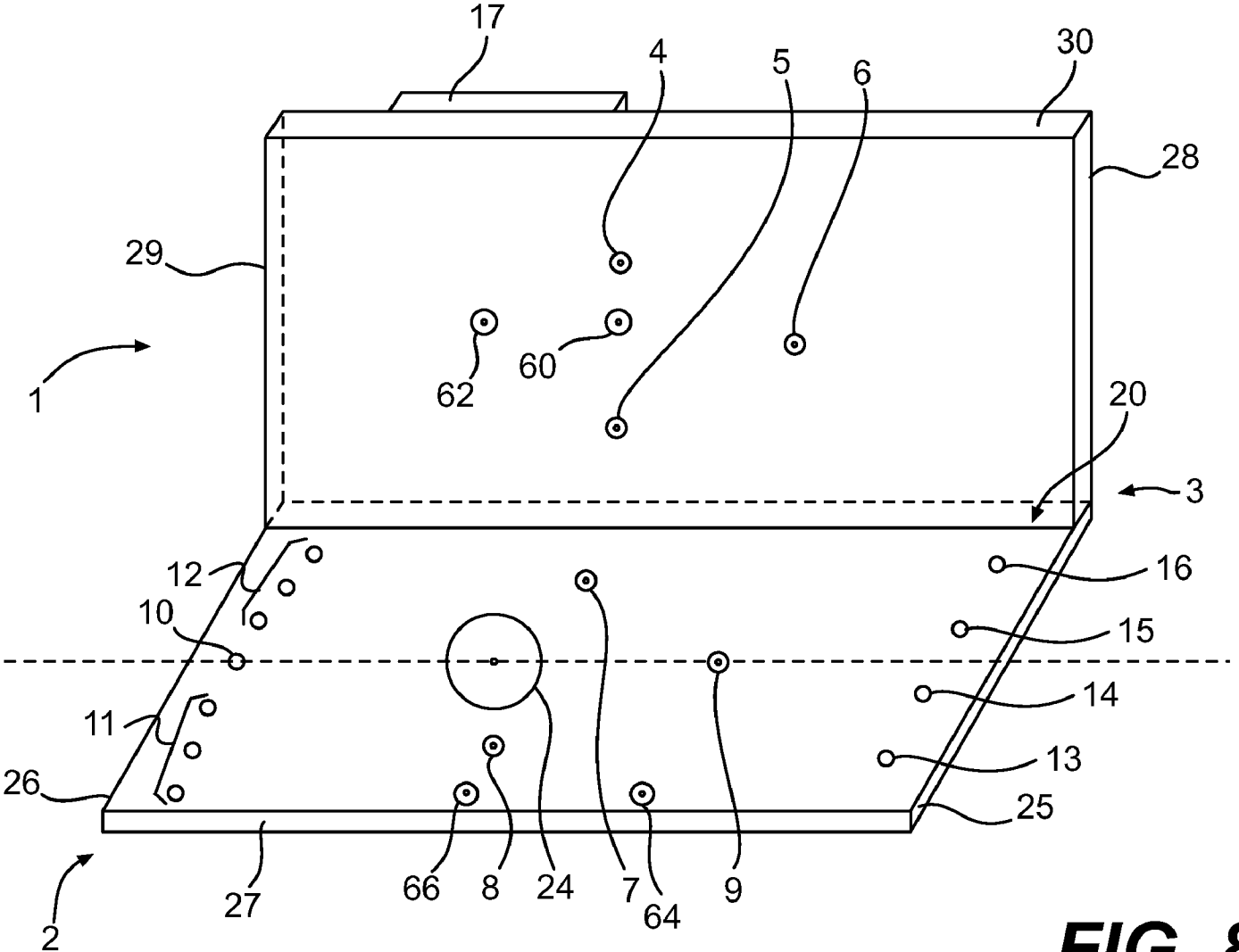
FIG. 8 is a perspective view of a system for analyzing the swing of a putter having optional slide sensors, in accordance with embodiments of the present invention.

In addition to the sensors described above, the system may comprise additional optional sensors to detect slide (whether the putter head cuts across the ball, causing left to right side spin or right to left side spin). This would be useful in helping user to determine if right or left sidespin was being influenced upon the ball. For the professional golfer this information could be very valuable to improve downhill putts. A user may practice the sidespin intentionally to slow the ball and draw or fade into hole. This gives the user more practiced control on very difficult putts. FIG. 8 is a perspective view of a system for analyzing the swing of a putter having optional slide sensors, in accordance with embodiments of the present invention. Two pairs of PIR sensors (60-64) and (62-66) can be added to the device to determine the amount of slide introduced on a club head forward swing. These sensors are positioned in a way that creates an angle between these added sensors and sensors (6-9) and (4-8). A first time delay is determined by the timing of the forward swing club head travel from when the club head passes through and is detected by the beam produced by pair (60-64) to when it passes through and is detected by the beam produced by pair (6-9). A second time delay is determined by the timing of the forward swing club head travel from when the club head passes through and is detected by the beam produced by pair (62-66) to when the club head passes through and is detected by the beam produced by pair (4-8). A perfectly straight swing (i.e., a swing that is parallel to the center line of the device) will result in these two time delays being substantially equal. Difference in the two time delays will determine direction and severity of slide, which will be compensated by speed (in a manner similar to the compensation for club face angle) to precisely determine slide severity at any swing speed. The determined slide may be displayed on the device display 17. Revealed slide determinations will be reset similarly with a positive-to-negative edge transition imposed on PIR pair (6-9).

Sensitivity can relate to the sensitivity of the programming as to how precise you want the specifications for the given result. For instance if you program the device or specific program to be very sensitive, it would require exact responses to get your given results (for instance: results a pro golfer would want). Less sensitive programming would give forgiveness for a child's or novice response so as to keep them from being discouraged while practicing their swings.

Sensitivity is how hard you need to hit the ball based on the given conditions. It can be used to describe the stimp which would need to be set to hit the virtual ball harder or easier based on whether the stimp was slower or faster. It is used to describe the feel the golfer has learned (to feel in his/her: fingers, hands, arms, shoulder, torso, legs and golf swing.) This translates to more accurate putts when repeat sensitivity (feel) is repeatable or learned. Also in the very similar sense of what golfers call touch around the greens. Sensitivity can also be related to the degree of difficulty in which a setting is established either making the game, task, training or exercise either easier or harder. Sensitivity is user selectable and functions in a way to display more exaggerated error for a user who wants to improve their skills. One of many for example would be timer error values can be multiplied for more advanced users leading to more exaggerated but proportional outputs.

Figure 9:
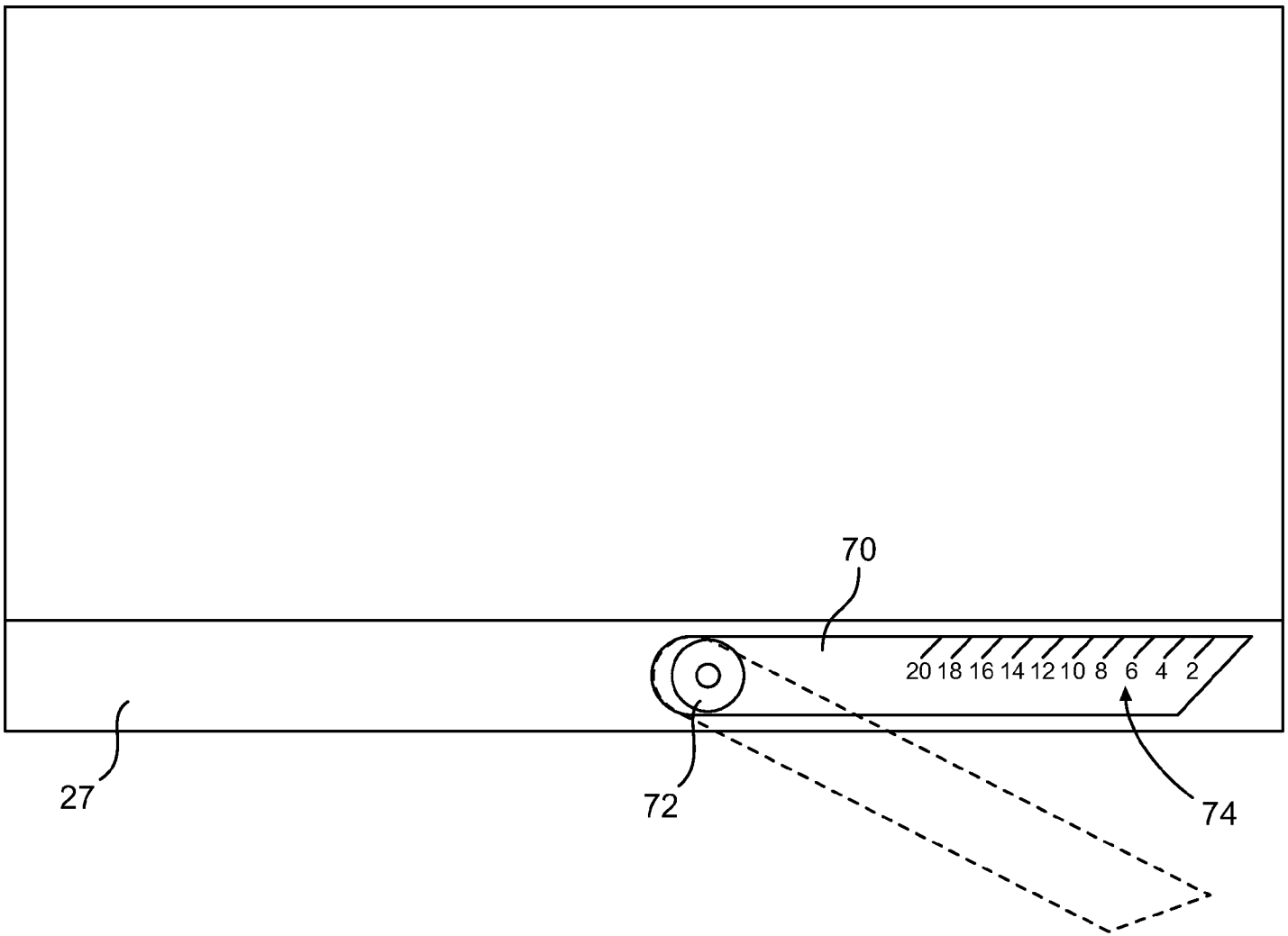
FIG. 9 is a face view of a system for analyzing the swing of a putter having an optional mechanism for setting front-to-back slope, in accordance with embodiments of the present invention.

The device may have one or more optional positioning elements to enable a portion (or portions) of the device to be elevated above the surface on which the device is placed. FIG. 9 is a face view of the device with an optional mechanism for setting front-to-back slope, in accordance with embodiments of the present invention. The mechanism is mounted on the front edge 27 and comprises a pivoting arm 70 mounted on a pivot point 72. The arm is secured at the pivot point with a fastening mechanism that is readily loosened or tightened (e.g., a wingnut or other method of fastening and tightening device such as quick release springs or clamps mounted inside or outside of the unit for instant deployment and retraction of arms.) to enable the arm to rotate downward from a horizontal position into a position corresponding to a desired front-to-back angle (i.e., the arm 70 raises the front edge 27 above the surface on which the device is placed) and to be locked into the desired position. A plurality of angle indicators 74 are marked on the arm, such that the device will be at a particular angle when the corresponding angle indicator is even with the bottom edge of the front edge 27. The device may also comprise a similar pivoting arm on the back edge (not illustrated) to raise the back edge to create a desired back-to-front angle.

Figure 10B:
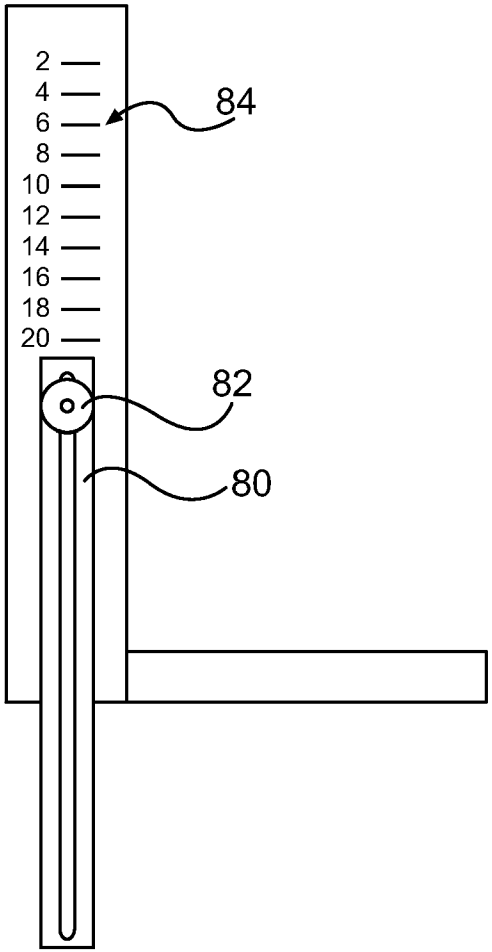
FIG. 10 is a side view of a system for analyzing the swing of a putter having an optional mechanism for setting side-to-side slope, in accordance with embodiments of the present invention.
Figure 10A:
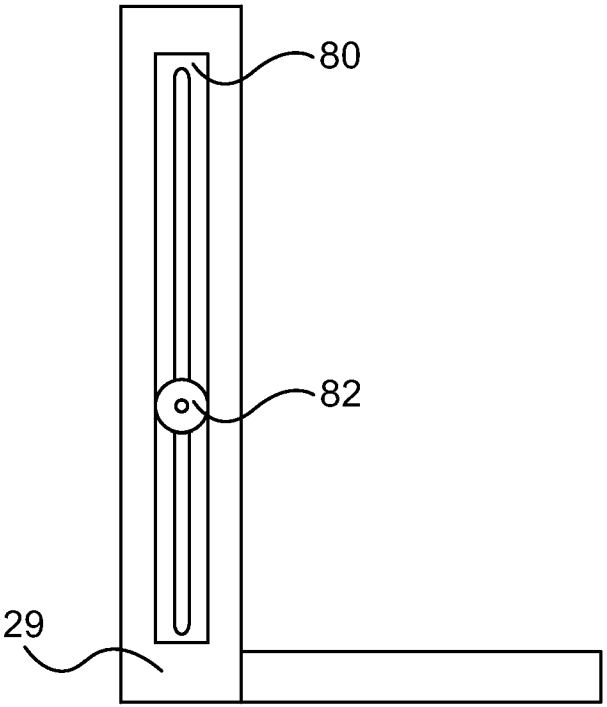

In addition to the mechanisms for setting a desired front-to-back and back-to-front angle as discussed above, the device may also comprise one or more mechanisms for setting a desired side-to-side (i.e., foreswing-to-backswing or backswing-to-foreswing) angle. FIGS. 10A and 10B are side views of the device with an optional mechanism for setting side-to-side slope, in accordance with embodiments of the present invention. The mechanism is mounted on the foreswing end 29 of the upper deck and comprises a sliding arm 80 mounted on a slide point 82. The arm is secured at the slide point with a fastening mechanism that is readily loosened or tightened (e.g., a wingnut) to enable the arm to slide downward such that the bottom end of the arm extends below the bottom deck of the device into a position corresponding to a desired foreswing-to-backswing angle (i.e., the arm 80 raises the foreswing end above the surface on which the device is placed) and to be locked into the desired position. A plurality of angle indicators 84 are marked on the arm, such that the device will be at a particular angle when the corresponding angle indicator is even with the top end of the arm. The device may also comprise a similar sliding arm on the backswing end (not illustrated) to raise the backswing end to create a desired backswing-to-frontswing angle.

The system may comprise an optional accelerometer/inclinometer to instantly let the user know the degree of slope of the surface (in two dimensions—foreswing to backswing and front edge to back edge) on which the system is sitting. The accelerometer/inclinometer would typically be mounted in the lower deck 2 of the device. This teaches the user to be able to correctly eyeball the degree of slope.

Embodiments of the invention comprise a novel device designed with only three sensors equipped to detect many aspects of a club head while practice putting, such as squareness of club head to target at impact, degree of tilt of club head if not directly perpendicular at impact, slide (optionally) (whether putter head cuts across ball causing left/right side spin) of club across target if any, and speed of club to determine distance a ball or simulated ball is hit. The user may select a stimp from 0-15. Degree of slope may be determined or simulated (with the above-described slope mechanisms) and displayed, with optional accelerometer/inclinometer which teaches the user to be able to correctly eyeball the degree of slope. The user may select a slope to practice putting on the selected slope or may simulate a slope by just tilting the device and optimally deploying arms and using the optional accelerometer/inclinometer to tell them the slope. Stimp and slope may be selected together to simulate many different putting greens. The user can accurately practice putts before or while on the putting green while others are hitting or putting out.

Optional sensitivity mode allows the user to select the desired programming to determine the level of challenge. At a child's level, for example, the device would be very forgiving, a novice more advanced, and a pro player very unforgiving (high tolerances). For example, consider a situation in which a child putts on the device with the club head angled to the left (e.g., at five degrees) and a pro player putts on the device with the club head at the same angle. At a child's level, the light just left of the center LED may light for the child. However, at a pro player's level, two or three lights to the left of the center LED may light for the same face angle.

This device allows the user to quickly adjust the device to the course greens slope and stimp while on flat ground and practice the stroke repeatedly. The user is provided audible, visual and physical feedback allowing them to learn the proper pace of the putting stroke for that type of shot while making them also tilt (if angle finder arms are deployed) their shoulders (a very important aspect of the putting stroke that most golfers never learn) to the slope of the greens regardless of foot position.

The system is compact and portable, fitting in a golf bag. Rechargeable batteries or a solar panel allow for usage outdoors. The system may fold to minimize space consumption and further protect components. This device can be used just about anywhere in any naturally occurring light source.

The optional game portion of this device allows users who have just played a round but are not yet ready to go home to beef up on their skills while still competing with one another. Children may gain interest in golf by enjoying the intrigue while developing the motor skills and touch the sport requires. Examples of possible games that may be provided in embodiments of the invention are listed below. Games marked with (**) are useful for helping to improve the users ability in the game of golf.

Optional Long Putt/Short Putt Competition (**): the CPU selects a long putt and then a short putt, both are selected randomly. One long and one short putt completes one turn. Can have multiple players. The game teaches the natural progression from a normal first putt, to finishing up a typical shorter or tap in putt. Players will develop closer first putts.

Optional Long Putt/Tap In/Statistics (**): the CPU selects a long putt, and then you have to finish up the distance of what was left from the long putt. Can be played with statistics mode to average typical distance left to the hole from long putts. The game teaches the natural progression from a normal first putt and develops the rhythm of a typical finishing up of a hole.

Optional Nerve Stiffener (**): a game that introduces random noise lights or talking, or all to cause a distraction to the player. Players can use long putt or any number of games to practice nerve stiffener. The game is used to build the nerves and concentration while developing a since of acceptance of peripheral distractions.

Optional Major/Minor Random Replay (**): the CPU randomly selects putts that players have to emulate. Selects putts to give player a broad range of putting situations. Each player gets the same set of putts or could be set to get their own random set of putts. Putts can be selected from famous pro and semi-pro players and games from tournaments. Points are awarded by average of the closest to each hole. Sounds emulate the real situation of the pro and the tournament played in. It is similar to Long Putt but does not distinguish long or short putts. Basically a practice for first putts or any putt situation. Players get to simulate the pros and real game situations. Players can choose to be one of several well known professional golfers.

Optional Beat the Clock (**): the CPU initiates a sound, light or both to signal to the player that the LED has lit telling them the distance to hit the virtual ball as quickly, accurately and as straight as they can. Points are awarded based on the player's putting average relating to the speed/accuracy and straightness. The game is used to help a player to develop a quicker sense of play. It also helps the slower player and those who struggle with play when say a marshal speeds up play on the course.

Optional Statistics Game (**): a single or multiple players hits five ten foot putts (CPU generated distance), then each player hits five twenty foot putts (CPU generated distance). Points are awarded by computing each player's average putting distance according distance from the hole. The game develops a rhythm and gives the player an average of each distance they try to hit. It shows the player where his/her putting distance weaknesses are.

Optional Miniature Golf 3 6 9 or 12 hole (**): the CPU sets a course based on how many holes the player chooses. One hole may be eighteen foot putt up a five degree hill on a seven stimp. The second hole might be hit a five foot putt and make the third from the center LED light up. The player would have to finish the hole based on how far they missed the hole and would to make the requested lights activate. Scores would be tallied based on number of strokes to complete the hole. The game provides the fun of competing and playing miniature golf anywhere. Sights and sounds keep the players engaged and having fun.

Optional Putt for Putt (**): the CPU simulates a putt it wants the player to make such as a twenty four foot, eight degree down hill, eleven stimp putt. The player would try and finish out, then his/her competitors (if multi player) would try the same putt. The game has levels of difficulty that are selected. Scores are awarded based on number of player's putts. The game allows the players who just finished playing golf, tennis etc. the opportunity to go to a lounge and keep playing and competing for fun, for bets or for whatever.

Optional Perfect the Slope (**): the CPU deals solely with slope. User can add stimp as an option to practice up and down hill putts based on what the CPU selects for the player. Can be sequential increments from say 5, 8, 12, 15, 18 etc. All initially uphill and then subsequently downhill. Or the CPU can choose random selects for the player. Single or multiple player scores are total to hole out. Player can use the degree slide mounted on base in conjunction with the accelerometer/inclinometer to simulate actual angle for real live action and training This gives the player a real unique feel for around the greens in reference to the angle of the shoulders and the adjustments necessary to make such putts.

Optional Pig or Horse (similar to the basketball game): the first player toggles "game" to select their favorite shot. Allowed a number of toggles to select for times sake. If they make a hole in one or three putt, the next player beats them at this hole if they do it in one stroke less. If they beat them then they toggle and lead off the next round. Points are awarded when the person following does not match the number of strokes or beat the lead player. The lead player does not ever get a letter. The player has to be in the trailing position to get a letter. Each player gets three losses for PIG and five for HORSE. A very fun and competitive game played through out the years in other sports (basketball). Great for building competition and jesting with competitors.

Optional Putt Cricket: single or multiple players take turns having to light (and as another option un-light) the LED light until all have been triggered for their each individual's turn. Points are awarded to the winner for being the first player to accomplish this task. A fun dart game over the years, now offered to the golfer. This game is fun and competitive.

Optional Baseball: the CPU causes a stream of LEDS to sequentially light while a baseball sound is ramping up to let the user know the ball has been pitched. The player must swing at the right time to hit the ball in the direction the CPU suggests. For instance, if the CPU shows the second from the end on the right to be lit, then this would mean the player would have to hit it very close or it would be one strike. Three strikes and you're out. The two farthest outside lights are foul balls and strikes. A run is when you have four hits and have not received three outs. A hit could be counted as a double if a player gets two or three hits in a row. This game is fun for kids and adults alike. It challenges special intelligence and acclamation.

Optional Dunk the Clown: corny noises or statements can be tastefully directed at the player much like the carnivals. The clown is dunked when a player successfully matches the speed and angle to the hole. A player is allowed a certain number of attempts. Lights and LEDs may be involved too. A fun feedback and interactions game, particularly for kids.

Optional Casino Fun: The player hits the virtual ball to make it go twice the distance the CPU says to. The program is set to bounce the ball back, say a player is told to hit it twenty yards and they swing for forty and it comes back within seven. If that is the number the player bet on then they win. The game may make casino noise, lights etc. It is a great competitive game and a lot of fun.

Optional Nail the Pendulum: the CPU directs the LEDs to strobe back and forth. When the player crosses the sensors he/she must be directed in the angle of hitting the light. A great focus and timing game.

Optional Coaching Mode: the Coach (CPU Coaching Program) basically has several modes from beginner (tells instructional how to hold club, rhythm, relax etc.) to expert. The coach sets up a putt for the player and after the putt then gives visual and or verbal feedback to help the player to improve. The coach can also include encouraging sayings as well as golf clichés giving on board instant feedback based on the results of the putt. The coach is able to use results against what was expected to make suggestions to the player while building the players confidence. The coach's feedback helps to remind players who have strayed from fundamentals and experience doing the wrong thing over and over again making it very difficult to get results.

Optional Stimp Finder Exercise (**): the user putts the device on the lower deck as previously described using a real ball and attempts to hit the ball five feet. It doesn't matter is the ball goes five feet (this number is only to try to get the user to hit a determined marginal distance as an example), what matters is how far the unit says it went on the display versus how far it actually went on the given green. If the user attempted to hit the ball five feet and the device displayed eight feet on the display and the ball actually went ten feet, then the unit would prompt the input of how far the ball actually rolled on the testing surface, because the substraights will have different surfaces and will cause the actual distance to usually be either longer or shorter. If the ball went eight feet based on the display, then the user would then measure how far it actually went in reality on the actual sub-straight (in this example 10 feet). The unit would ask for the actual distance and the user would input it. This would give the device the actual stimp of the sub-straight based on the differences of the two numbers. This gives the user a good sense of speed and sub-straight differences. An optional transition ramp may be used to transition the thickness of the unit to the greens or sub-straight that the ball would be rolling onto too, to reduce any drop of the ball, and yet transition it smoothly. Any speed picked up from a drop or transition ramp would be accommodated in the calculations to closely relate the give difference in deriving the stimp. This could be set-up to be used as a course calibration for the unit prior to playing by using it on the practice putting green prior to play and again at the turn of the 9th hole on the practice green to help keep track of the changing of the stimp on the greens due to moisture changes throughout the day. The user could set the difference in the unit to calibrate temporarily for that session to use the variable (found stimp based on the results) until the next session or the defaults were restored. This would give the user the proper relative results of the real distances on the display as to what the course was actually doing.

Optional Stimp indicator: can use the Eddie Stimpson method of using a predetermined ramp and a golf ball on a predominately flat green allowing the golf ball to roll down the ramp past the sensors multiple times. The user enters the data in this mode by measuring how far the ball travels each time. The Stimp Indicator mode averages the distances and uses this information to determine stimp in the same manor that the Eddie Stimpson method does regarding calculations. The Eddie Stimpson method is the most widely used method at golf courses today.

Optional 9 or 18 hole Putt around Competition. Just like in playing the game of golf and each player approaches the green to putt their ball, each player takes a turn depending on who's first and how far their ball is still away from the hole. Each round (there are 9 or 18 rounds) the computer can either select the same starting distance or a random starting distance base on out of the 9 or 18 rounds that the computer selects the same distances through out the rounds for each player (they would just be hitting the different distances on each hole). Each player in turn would try to hit the computer selected distance. If the player hits the ball short or past the selected distance, then on their next turn during that round, they would have to hit again to make up the distance to the selected mark (past the mark two feet and they would have to hit the next putt two feet. Short one foot and they would have to hit the ball one foot). The players' number of strokes are tallied for each round and displayer as a leader board on the display. The player to have the least amount of strokes throughout the entire 9 or 18 rounds wins.

On many of these games, if the player hits the virtual ball past the hole, then his/her next putt would be to hit back to the hole. This could include: if the player was hitting a ball downhill five degrees and he/she hit past the hole two feet, then he/she would have a two foot putt uphill, five degrees. Also on any games, as well as during normal practice, the device can be used to make a ball hitting sound at virtual impact. Also during any of these exercises an actual ball can be used.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A golf putting swing analysis system for analyzing the swing of a golf club, the system comprising:

a first substantially planar surface adapted to be placed on a surface on which a user of the system is standing during use of the system, the first surface having a bottom side to be placed against the surface on which the user is standing, a top side opposite the bottom side, a backswing end, a foreswing end opposite the backswing end, a front edge adjacent to which the user is standing during use of the system, a back edge opposite the front edge, a golf ball target area, and a plurality of indicator lights mounted in the top side adjacent the foreswing end;

a second substantially planar surface affixed to and substantially perpendicular to the first surface, the second surface having a front side facing the user during use of the system, a back side opposite the front side, a backswing end, a foreswing end opposite the backswing end, a bottom edge, and a top edge opposite the bottom edge, the bottom edge of the second surface being affixed to the back edge of the first surface;

a plurality of sensors comprising first, second, and third pairs of emitters and corresponding receivers configured for detecting movement of a golf club head as the user swings the golf club above the first surface, the first pair comprising a first top side sensor element and a corresponding first front side sensor element, the second pair comprising a second top side sensor element and a corresponding second front side sensor element, the third pair comprising a third top side sensor element and a corresponding third front side sensor element, the first, second, and third top side sensor elements being mounted in the top side of the first surface, the corresponding first, second, and third front side sensor elements being mounted in the front side of the second surface, the first, second, and third top side sensor elements being arranged in a triangular configuration between the target area and the backswing end, the first and second top side sensor elements being mounted equidistant from the target area and equidistant from an imaginary line that bisects the target area and is substantially parallel to the front edge, the third top side sensor element being mounted on the imaginary line and being closer to the first edge than are the first and second top side sensor elements, the first, second, and third front side sensor elements being mounted in a mirror-image arrangement to the corresponding first, second, and third top side sensor elements;

a display element; and a controller configured for receiving a signal from the plurality of sensors when any of the pairs of the plurality of sensors detect movement of the golf club head, the controller further configured for determining, based on the received signals, a timing of the movement of the golf club head and an angle of the golf club head relative to the imaginary line as the user swings the golf club head, the controller further configured for determining an anticipated distance a golf ball would travel based on the determined timing, the controller further configured for determining an anticipated direction in which a golf ball would travel based on the determined angle, the controller further configured for causing the display element to display the determined distance, the controller further configured for causing the plurality of indicator lights to indicate the determined direction.

2. The system of claim 1, wherein the controller determines the anticipated distance by comparing the determined timing of the movement of the golf club head to a table of predetermined times and corresponding distances.

3. The system of claim 1, wherein the controller is configured for determining the anticipated distance further based on a slope angle.

4. The system of claim 3, wherein the controller scales the anticipated distance up or down using a scalar value corresponding to the slope angle.

5. The system of claim 3, further comprising an incline detection element for detecting an incline of the surface on which the system is placed, wherein the slope angle used for determining the anticipated distance comprises the detected incline.

6. The system of claim 5, wherein the incline detection element comprises an accelerometer or an inclinometer.

7. The system of claim 3, further comprising one or more positioning elements for elevating a portion of the system above the surface on which the system is placed, each positioning element configured for elevating a different portion of the system.

8. The system of claim 1, wherein the controller is configured for determining the anticipated distance further based on a stimp value.

9. The system of claim 8, wherein the controller scales the anticipated distance up or down using a scalar value corresponding to the stimp value.

10. The system of claim 8, further comprising a user input for selecting the stimp value.

11. The system of claim 1, wherein the bottom edge of the second surface is hingedly affixed to the back edge of the first surface.

12. The system of claim 1, wherein the plurality of indicator lights comprise a center indicator light mounted on the imaginary line, a first plurality of side indicator lights on one side of the imaginary line, and a second plurality of side indicator lights on the other side of the imaginary line, and wherein the plurality of indicators lights are arranged in one of a linear arrangement or an arcuate arrangement.

13. The system of claim 1, wherein a distance between the first and second top side sensor elements is selected such that the first and second top side sensor elements are able to detect the golf club head simultaneously.

14. The system of claim 1, wherein the first, second, and third top side sensors are flush mounted in the top side of the first surface and wherein the first, second, and third front side sensor elements are flush mounted in the front side of the second surface.

15. The system of claim 1, wherein the first, second, and third top side sensor elements are recess mounted in the top side of the first surface and wherein the first, second, and third front side sensor elements are recess mounted in the front side of the second surface.

16. The system of claim 15, wherein each of the top side sensor elements are recess mounted in a cavity that is angled toward the respective corresponding front side sensor element, and wherein each of the front side sensor elements are recess mounted in a cavity that is angled toward the respective corresponding top side sensor element.

17. The system of claim 1, wherein the plurality of sensors comprises only first, second, and third pairs of emitters and corresponding receivers.

18. The system of claim 1, wherein the plurality of sensors comprises fourth and fifth pairs of emitters and corresponding receivers, the fourth pair comprising a fourth top side sensor element and a corresponding fourth front side sensor element, the fifth pair comprising a fifth top side sensor element and a corresponding fifth front side sensor element, the fourth and fifth top side sensor elements being mounted in the top side of the first surface, the corresponding fourth and fifth front side sensor elements being mounted in the front side of the second surface, the fourth top side sensor element being mounted at a distance from the foreswing end of the first surface that is greater than a distance at which the fourth front side sensor element is mounted from the foreswing end of the second surface, the fifth top side sensor element being mounted at a distance from the foreswing end of the first surface that is greater than a distance at which the fifth front side sensor element is mounted from the foreswing end of the second surface, the fourth top side sensor element being mounted at a distance from the foreswing end of the first surface that is substantially equal to a distance at which the fifth front side sensor element is mounted from the foreswing end of the second surface, the fourth and fifth top side sensor elements being mounted equidistant from the front edge, the fourth and fifth top side sensor elements being mounted equidistant from the bottom edge.

19. The system of claim 18, wherein the controller is further configured for determining, based on the received signals, a slide of the golf club head relative to the imaginary line as the user swings the golf club head, the slide comprising an angle at which the movement of the golf club head is off-axis from the imaginary line, and wherein the controller is further configured for causing the display element to display the determined slide.

* * * * *